US006499384B1

(12) United States Patent
Blair

(10) Patent No.: US 6,499,384 B1
(45) **Date of Patent: *Dec. 31, 2002**

(54) PISTON APPARATUS FOR GAS/LIQUID PIPELINE

(76) Inventor: Jim S. Blair, P.O. Box 208, Morrin, Alberta (CA), T0J 2B0

( * ) Notice: Subject to any disclaimer, the term of this patent is extended or adjusted under 35 U.S.C. 154(b) by 0 days.

This patent is subject to a terminal disclaimer.

(21) Appl. No.: 09/722,674

(22) Filed: Nov. 28, 2000

(51) Int. Cl.[7] ..... F01L 15/12
(52) U.S. Cl. ..... 91/224; 91/344
(58) Field of Search ..... 91/224, 229, 344

(56) References Cited

U.S. PATENT DOCUMENTS 907,250 A * 12/1908 Lavoie ..... 91/229
6,065,387 A 5/2000 Blair ..... 91/224

* cited by examiner

*Primary Examiner*—Edward K. Look
*Assistant Examiner*—Michael Leslie
(74) *Attorney, Agent, or Firm*—I. Zborovsky

(57) ABSTRACT

A reciprocating fluid driven apparatus has a hollow elongate barrel with an inlet and an outlet in fluid communication with portions of a pipeline, a piston reciprocating within the barrel and having a through hole for fluid communication between spaces above and below the piston, and a cyclically operable closure member for opening and closing the through hole allowing upward and downward piston movements, the piston having piston rods extending from an upper end and a lower end of the piston to an exterior of the barrel so that a pressure at opposite sides of said piston is balanced to allow operation at unlimited pressures.

8 Claims, 2 Drawing Sheets

PISTON APPARATUS FOR GAS/LIQUID PIPELINE

BACKGROUND OF THE INVENTION

The present invention relates to a piston system and apparatus for harnessing energy from a pressurized fluid flowing in a pipeline.

Fluids flowing through a pipeline are typically under pressure to provide motive energy to the fluid. A fluid, namely liquid or gas, which is under pressure from natural sources such as oil or natural gas from an underground reservoir or well may be harnessed in whole or part to perform other functions or tasks. At well sites in the oil and gas industry, for instance, energy is often needed to operate instrumentation and pumps for a variety of purposes, including glycol dehydration, methanol injection, heat tracing of liquid lines, chemical injection, and the like.

At remote well sites where delivery of electricity is not feasible from an existing power grid, the associated pumps must be operated by other means. Typically, at natural gas well sites, a portion of the gas from the well's main gas stream is diverted for running the instrumentation and pumps. A significant drawback of these existing arrangements is that the gas is vented to atmosphere as exhaust after being used in the pumps and instruments. There appeared to be no practical and economical means for recovering such vented gas, particularly since the exhaust is at a significantly lower pressure than that of the gas pipeline. Hence, well site operators are faced with the undesirable results of emitting raw gas to atmosphere, which is believed to be detrimental to the environment, as well as losing the opportunity to sell the vented gas.

A new system and apparatus which overcomes the limitations and problems of the prior pump arrangements was proposed in my U.S. Pat. No. 6,065,387. In the apparatus disclosed in this patent a hollow elongate barrel having a top end, an opposed bottom end with an inlet in fluid communication with an upstream portion of the pipeline, and an outlet located intermediate the top and bottom ends in fluid communication with the pipeline downstream of the upstream portion are provided. A piston is movable upwardly in the barrel by pressurized fluid beneath the piston to an upper limit of travel upon the closure member closing the throughhole and the piston is allowed to fall by the force of gravity from the upper limit of travel to a lower limit of travel upon the closure member opening the throughhole to allow the fluid beneath the piston to travel to the interior cavity and to the outlet of the barrel for discharge into the downstream portion of the pipeline. A piston rod extends from the upper end of the piston and slidably through the top end of the barrel in a relatively fluid tight manner for transferring movement of the piston to the exterior of the barrel. This apparatus represents a fairly simple and compact device with a few moving parts for efficiently and automatically harnessing energy from a pressurized fluid stream in a pipeline to perform a desired task. The system is fully self contained in that any fluid diverted from the main fluid stream is returned to that fluid stream without any venting to atmosphere. The harnessed energy may be transferred elsewhere mechanically, such as by a movable piston rod to perform work such as pumping or compressing other fluids, or by other suitable means such as an electrical transfer. The above described apparatus can however be further improved.

SUMMARY OF THE INVENTION

Accordingly, it is an object of the present invention to provide a piston apparatus for gas/liquid pipeline of the above mentioned type, which is a further improvement of the existing apparatus.

In keeping with these objects and with others which will become apparent hereinafter, one feature of present invention resides, briefly stated, in an apparatus which has a hollow elongate barrel having a top end, an opposed bottom end, an inlet in fluid communication with a portion of the pipeline, and an outlet in fluid communication with another portion of the pipeline; a piston located within said barrel for reciprocating sliding therein in a relatively fluid-tight manner, said piston having a through hole for fluid communication between a space above said piston and a space below said piston, and a cyclically operable closure member for opening and closing said through hole, said piston being moved upwardly in said barrel by the pressurized fluid beneath said piston to an upper limit of its travel upon said closure member closing said through hole and being allowed to fall by force of gravity from said upper limit of travel to a lower limit of travel upon said closure member opening said through hole to allow said fluid beneath said piston to travel above said piston for discharge of the fluid into the pipeline, said piston including a piston rod extending from an upper end of said piston through said top end of said barrel in a relatively fluid-tight manner for transferring movement of said piston to an exterior of the barrel, and a lower piston rod extending from a lower end of said piston through said bottom end of said barrel in a relatively fluid-tight manner for transferring movement of said piston to an exterior of said barrel.

When the piston apparatus is designed in accordance with the applicant's invention, it allows a load to be connected to either or both ends of the apparatus. A further important benefit of connecting a piston rod to each of the upper and lower ends of the piston, is that it allows the device to operate at unlimited pressure. The piston surface exposed to the pressurized fluid on the upper end of the piston is equal to that on the lower end of the piston. When a rod is used only on the upper end, the above mentioned surface areas are not equal, and the undesirable result is that the piston can be held at the upper limit of travel indefinitely, by the greater force on the lower end, due to the greater surface area on the lower end.

Another important improvement lies in the closure member apparatus, which achieves a "snap action" of the valve and full travel of the valve to its limits in both directions. As a result, the situation is eliminated where the valve may open only partially, or close only partially, and the piston "stall" in a state of equilibrium.

A third significant improvement is the fact that the valve now enters into the opening, to close off the through hole. This ensures equal area on top and bottom surface of the valve, exposed to the pressurized fluid. A valve which simply covers over the opening, as in the prior art, has the problem of unequal areas exposed to the pressurized fluid, and requires greater total force to open it.

A cost saving improvement is the fact that the cylinder ends are now simply flat surfaces. No cone is required on the underside of the top end, and no bridge is required on the upper side of the bottom end.

Still another improvement is that fluid exits the barrel out the top end, just as it enters through the bottom end. No opening is required through the side wall of the barrel or cylinder.

Finally, the piston no longer has to be a hollow structure. It is simply a solid piece with a hole through it.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
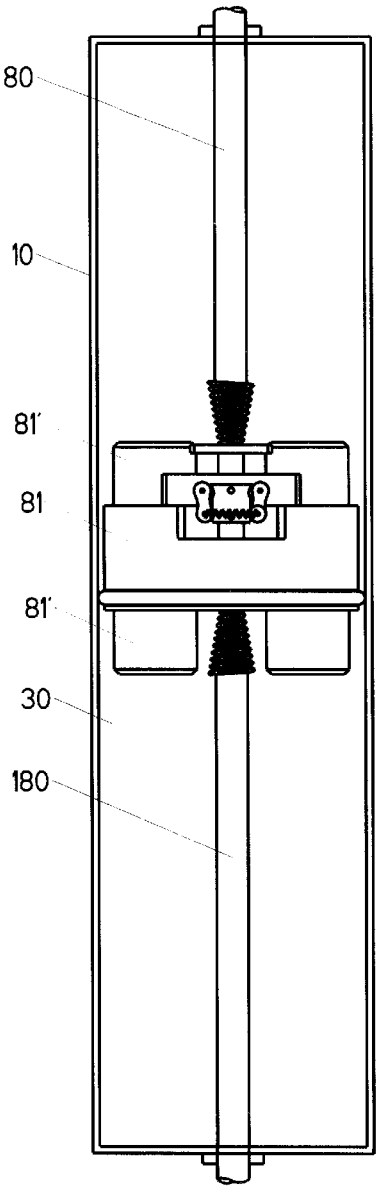
FIG. 1 is an elevated cross-sectional side view of a piston apparatus of the present invention.

A reciprocating fluid driven apparatus of the present invention is identified as a whole with reference numeral 10 and is mounted to a pipeline 12 carrying fluid under pressure. The apparatus 10 is also referred to herein as a motor or engine since it harnesses energy into mechanical motion, and its mechanical motion is imparted to another device to perform other desired tasks and purposes, such as described herein above. The fluid can be any transportable fluid or gas capable of flowing through a pipeline under low or high pressure. For illustrative purposes the pipeline 12 may be considered one that handles natural gas from a natural gas well head which may have a pressure of several PSI to several hundred PSI.

The pipeline has an upstream portion 14, a downstream portion 16, and a bypass portion 18 therebetween. At least some of the gas from the upstream portion 14 will flow into the apparatus 10 and then exit the apparatus into the downstream portion 16. Hence, none of this gas is discharged into the atmosphere but remains within the pipeline system for further use or sale. A differential pressure regulator 20 located in the bypass 18 controls or maintains a differential pressure drop across the regulator, namely a greater pressure in the upstream portion 14 than in the downstream portion 16, for operating the motor apparatus 10. The regulator 20 is preferably a manually or automatically controlled valve which opens to allow gas flow from the bypass 18 to the downstream portion 16 upon reaching a pre-set pressure differential between the upstream and downstream portions. Good results have been achieved using a check valve with a spring having a compression value of two to five pounds as disclosed in my U.S. Pat. No. 6,065,387. In other words, the valve opens if the force of the differential pressure in the bypass reaches the spring compression value. The check valve is adjustable to vary differential pressure, thereby controlling the stroking rate of the piston and the amount of energy transferred or harnessed by the motor.

The motor apparatus 10 has a main outer body, mainly a hollow elongate barrel 30, slidably housing the piston rod 80 in its upper part and the piston rod 180 in its lower part. The barrel 30 has a generally smooth inner surface forming an inner cavity for accommodating the piston 81, and rods 80 and 180. The barrel 30 is mounted onto the pipeline 12 generally vertically to allow the force of gravity to pull the piston rods 80 and 180 on a downward stroke. On the top and bottom ends of the barrel 30 head pieces with seals can be provided through which the piston rods pass, as disclosed in my U.S. Pat. No. 6,065,387. The piston rods 80 and 180 are mounted into a piston 81 which is formed as a solid member having upper and lower bumpers 81'. The lower end of the piston rod 80 and the upper end of the piston rod 180 can be screwed into a throughgoing threaded opening of the piston 81. The piston 81 is provided with a seal 82 on its periphery for sealing the piston relative to the barrel 30. A spring 83 is located at the upper end of the piston 81 on a plate 83' to store energy for opening of a valve, and a spring 84 is located at the lower end of the piston 81 on a valve plate 84' to store energy for closing of the valve. Two levers 85 and 86 are pivotably connected to a valve block 92 at their upper ends in the pivot points 87 and 88. The lower ends of the levers 85 and 86 are connected with one another, for example at the point 88 and 89 by a springs 90 which biases the levers inwards to create a resistance to the movement of a valve shaft 91. The valve shaft 91 is vertically movable in a valve block 92 which is mounted on the piston 81. Two sets of levers and two springs can be provided at opposite sides of the block. These sets are connected by a pin on which the rollers 95 are mounted. The pin connecting one set of levers, and the pin connecting the other set of levers, become the means for attaching the springs 90–which move freely on a pin connecting the lever 85 with a mating lever 85 and connecting the lever 86 with a mating lever 86.

The levers 85 and 86 can hold a set of rollers 95 on their respective pins. The force of the spring 90 holds the rollers in a groove or detent 96 on the valve shaft 91, so as to hold the valve in a closed position when it is closed, and in a second detent 97 on the valve shaft 91 holding the 20 valve in the open position when it is open. A throughgoing opening or path 98 is formed through the piston when the valve is open, because gas can now travel through the hole in the piston, and up around the valve block 92, which is narrow in comparison to a large milled out area of the piston, over which the valve block 92 is mounted.

Figure 2:
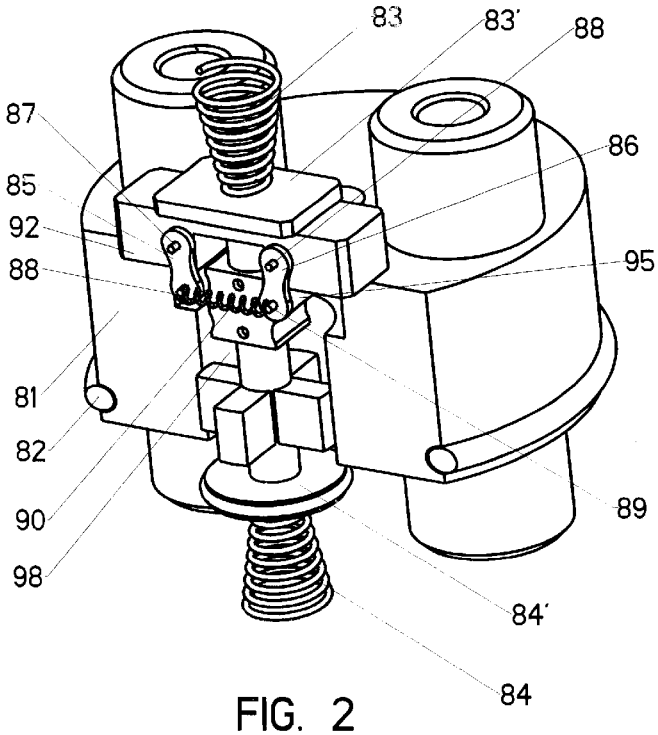
FIG. 2 is a view showing a piston of the piston apparatus of FIG. 1.
Figure 3:
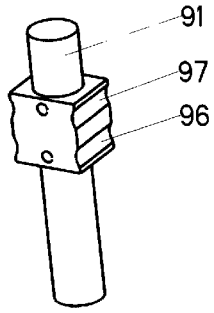
FIG. 3 is a view showing a valve rod of the piston apparatus of FIG. 1.
Figure 4:
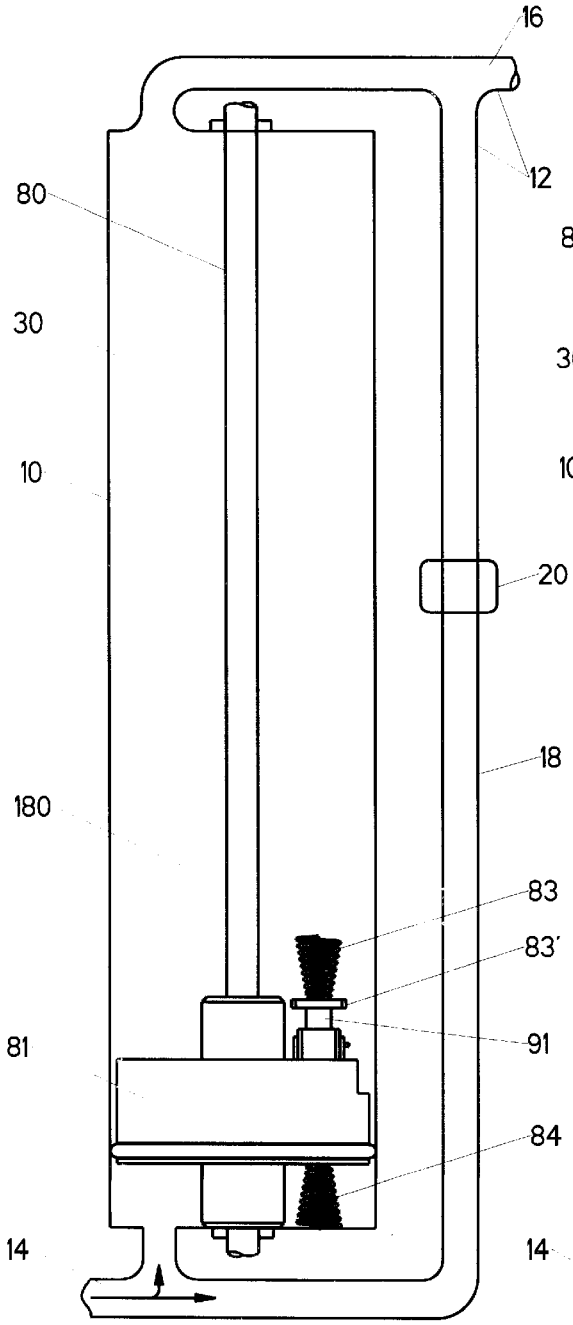
FIGS. 4 and 5 are front views showing the piston of the piston apparatus in lower and upper positions correspondingly.
Figure 5:
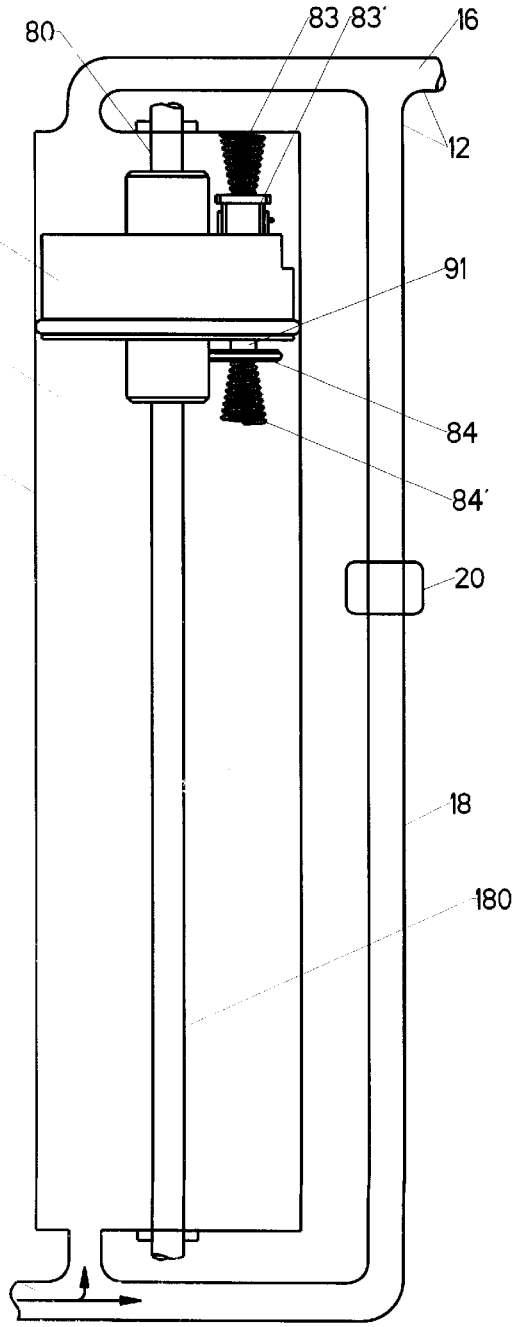

The motor apparatus 10 in accordance with the present invention operates in the following manner. When the piston 81 approaches the bottom of the barrel 30 on a downward stroke, the valve shaft 91 is in an extended or open position which allows gas beneath the piston to flow through the piston, namely through the throughgoing opening or path 98. The rollers 95, on pins held by the lower ends of the levers 85 and 86 are engaged in the detents 97 and hold the valve in its open position as shown in FIG. 2. The piston 81 continues falling by force of gravity to the bottom of the barrel 30, and the spring 84 reaches the bottom and is compressed to a degree as the weight of the piston is applied to it. When the spring 84 stores sufficient energy, it overcomes the force of the spring 90 of the levers 85 and 86, the lower ends of the levers move outward as the rollers 95 disengage from the upper detent 97, unlocking the valve shaft 91, and move into the lower detent 96, as the valve plate 84' enters the hole in the piston 81, closing the throughgoing opening 98. With the valve closed, the fluid no longer flows through the piston. Pressure of the fluid is built below the piston due to the pre-set resistance of the differential pressure regulator 20 on the bypass 18, and when a sufficient pressure is reached, the piston 81 is lifted and moves upwardly.

When the piston 81 approaches the top of the barrel 30 on an upper stroke, the upward spring 83 reaches the top of the barrel 30 and is compressed as the piston keeps rising. When the spring 83 stores sufficient energy, it overcomes the force of the spring 90, the lower ends of the levers 85 and 86 move outwardly as the rollers 95 disengage from the lower detent 96, again unlocking the valve shaft 91, and move into the upper detents 97, as the valve plate 84' moves downwardly and the valve is open to release a throughgoing opening 98. The fluid flows through the piston 81, the pressures above and below the piston 81 suddenly equalize when the valve is open and the piston begins its downward stroke. The outside devices connected with the outer ends of the piston rods 80 and 180 are operated during this reciprocating vertical movement.

In the inventive apparatus, where the vertical springs are energized until they overcome the detent springs of the levers, snap action of the valve into its closed and open positions in both directions is ensured. This eliminates the situation when the valve may only partially open or only partially close, and the piston may stall in a state of equilibrium.

As for other elements of the inventive apparatus, they substantially correspond to the apparatus described in my U.S. Pat. No. 6,065,387 which is incorporated here by means of a reference.

It will be understood that each of the elements described above, or two or more together, may also find a useful application in other types of constructions differing from the types described above.

While the invention has been illustrated and described as embodied in piston apparatus for gas/liquid pipeline, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A reciprocating fluid driven apparatus for a pipeline system carrying fluid under pressure, the apparatus comprising a hollow elongate barrel having a top end, an opposed bottom end, an inlet in fluid communication with a portion of the pipeline, and an outlet in fluid communication with another portion of the pipeline; a piston located within said barrel for reciprocating sliding therein in a relatively fluid-tight manner, said piston having a through hole for fluid communication between a space above said piston and a space below said piston; and a cyclically operable closure member for opening and closing said through hole, said piston being moved upwardly in said barrel by the pressurized fluid beneath said piston to an upper limit of said travel upon said closure member closing said through hole and being allowed to fall by force of gravity from said upper limit of travel to a lower limit of travel upon said closure member opening said through hole to allow said fluid beneath said piston to travel above said piston for discharge of the fluid into the pipeline, said piston including a piston rod extending from an upper end of said piston through said top end of said barrel in a relatively fluid-tight manner, and lower piston rod extending from a lower end of said piston through said bottom end of said barrel in a relatively fluid-tight manner so that a pressure at opposite sides of said piston is balanced to allow operation at unlimited pressures.

2. A reciprocating fluid driven apparatus for a pipeline system carrying fluid under pressure, the apparatus comprising a hollow elongate barrel having a top end, an opposed bottom end, an inlet in fluid communication with a portion of the pipeline, and an outlet in fluid communication with another portion of the pipeline; a piston located within said barrel for reciprocating sliding therein in a relatively fluid-tight manner, said piston having a through hole for fluid communication between a space above said piston and a space below said piston; and a cyclically operable closure member for opening and closing said through hole, said piston being moved upwardly in said barrel by the pressurized fluid beneath said piston to an upper limit of said travel upon said closure member closing said through hole and being allowed to fall by force of gravity from said upper limit of travel to a lower limit of travel upon said closure member opening said through hole to allow said fluid beneath said piston to travel above said piston for discharge of the fluid into the pipeline, said piston including a piston rod extending from an upper end of said piston through said top end of said barrel in a relatively fluid-tight manner, and lower piston rod extending from a lower end of said piston through said bottom end of said barrel in a relatively fluid-tight manner so that a pressure at opposite sides of said piston is balanced to allow operation at unlimited pressures, said closing member being a valve arranged on said piston and operative for closing and opening of said through hole; and locking means for locking said valve when it closes said through hole and when it opens said through hole correspondingly.

3. A reciprocating fluid driven apparatus as defined in claim 10, wherein said valve has a valve shaft which is movable substantially vertically between closed and open positions for closing and opening said through hole correspondingly, said locking means including a first detent means and a second detent means provided on said valve shaft and spaced from one another in a substantially vertical direction, and a set of levers which is selectively engageable in the corresponding one of said first and second detent means so as to lock said valve shaft in said closed and open positions correspondingly.

4. A reciprocating fluid driven apparatus as defined in claim 3; and further comprising another set of levers, and pins connecting the levers of said sets with one another.

5. A reciprocating fluid driven apparatus as defined in claim 3, and further comprising spring means connecting said levers with one another.

6. A reciprocating fluid driven apparatus as defined in claim 5, and further comprising a top spring and a bottom spring arranged at said upper end and at said lower end of said piston correspondingly so that when said piston reaches said top end of said barrel, said top spring is compressed and stores energy, and when said piston reaches said bottom end of said barrel said bottom spring is compressed and stores energy, said top spring and said bottom spring upon storing a sufficient energy overcoming a force of said spring means so as to allow disengagement of said levers from one of said detent means and engagement of said levers with another of said detent means.

7. A reciprocating fluid driven apparatus for a pipeline system carrying fluid under pressure, the apparatus comprising a hollow elongate barrel having a top end, an opposed bottom end, an inlet in fluid communication with a portion of the pipeline, and an outlet in fluid communication with another portion of the pipeline; a piston located within said barrel for reciprocating sliding therein in a relatively fluid-tight manner, said piston having a through hole for fluid communication between a space above said piston and a space below said piston; and a cyclically operable closure member for opening and closing said through hole, said piston being moved upwardly in said barrel by the pressurized fluid beneath said piston to an upper limit of said travel upon said closure member closing said through hole and being allowed to fall by force of gravity from said upper limit of travel to a lower limit of travel upon said closure member opening said through hole to allow said fluid beneath said piston to travel above said piston for discharge of the fluid into the pipeline, said piston including a piston rod extending from an upper end of said piston through said top end of said barrel in a relatively fluid-tight manner, and lower piston rod extending from a lower end of said piston through said bottom end of said barrel in a relatively fluid-tight manner so that a pressure at opposite sides of said piston is balanced to allow operation at unlimited pressures, said piston being formed as a solid member provided with said through hole which extends through said solid member.

8. A reciprocating fluid driven apparatus for a pipeline system carrying fluid under pressure, the apparatus comprising a hollow elongate barrel having a top end, an opposed bottom end, an inlet in fluid communication with a portion of the pipeline, and an outlet in fluid communication with another portion of the pipeline; a piston located within said barrel for reciprocating sliding therein in a relatively fluid-tight manner, said piston having a through hole for fluid communication between a space above said piston and a space below said piston; and a cyclically operable closure member for opening and closing said through hole, said piston being moved upwardly in said barrel by the pressurized fluid beneath said piston to an upper limit of said travel upon said closure member closing said through hole and being allowed to fall by force of gravity from said upper limit of travel to a lower limit of travel upon said closure member opening said through hole to allow said fluid beneath said piston to travel above said piston for discharge of the fluid into the pipeline, said piston including a piston rod extending from an upper end of said piston through said top end of said barrel in a relatively fluid-tight manner, and lower piston rod extending from a lower end of said piston through said bottom end of said barrel in a relatively fluid-tight manner so that a pressure at opposite sides of said piston is balanced to allow operation at unlimited pressures; and a top spring and a bottom spring arranged at said upper end at said lower end of said piston correspondingly so that when said piston reaches said top end of said barrel, said top spring is compressed and stores energy, and when said piston reaches said bottom end of said barrel said bottom spring is compressed and stores energy.

* * * * *